United States Patent [19]

Back et al.

[11] 3,992,930

[45] Nov. 23, 1976

[54] ENGINE CYLINDER IDENTIFICATION

[75] Inventors: Paul Roger Back, Somersville; Robert James Fraleigh, Vernon; Rocco Vincent Albano, Cromwell, all of Conn.

[73] Assignee: United Technologies Corporation, Hartford, Conn.

[22] Filed: Dec. 8, 1975

[21] Appl. No.: 638,880

[52] U.S. Cl. ..... 73/117.3; 324/15

[51] Int. Cl.[2] ..... F02P 17/00

[58] Field of Search ..... 73/116, 117.3; 324/16 S, 19, 15

[56] References Cited

UNITED STATES PATENTS 3,573,608 4/1971 Marino ..... 73/117.3 X 3,619,767 11/1971 Pelta et al. ..... 73/117.3 X

*Primary Examiner*—Jerry W. Myracle

*Attorney, Agent, or Firm*—M. P. Williams

[57] ABSTRACT

A number one cylinder ignition signal from an engine is utilized to initiate counting of low coil signals from the same engine, and coincidence of a count equal to the number of cylinders in the engine and a subsequent number one cylinder ignition signal causes generation of a valid one signal and shifting into a mode in which subsequent valid one signals are simply generated by the counting of low coil signals, whether or not coincident number one signals are present. Thus, pseudo number one signals are generated from low coil signals when in the run mode; the run mode will continue indefinitely unless the count overflows (as from a failure) or is re-initiated by external action.

9 Claims, 1 Drawing Figure

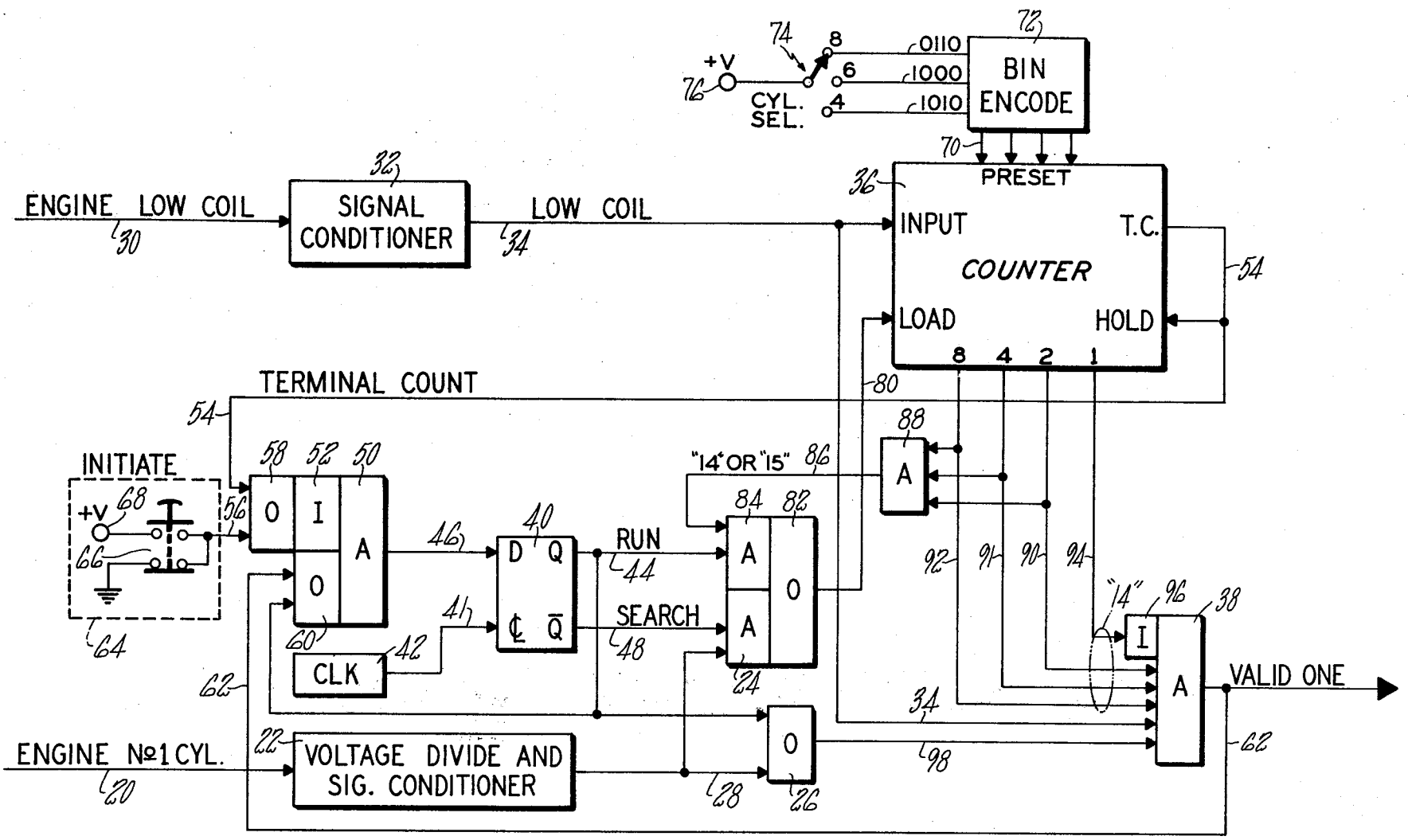
VALID ONE
BIN ENCODE
PRESET
COUNTER
T.C.
HOLD
INPUT
LOAD
CYL. SEL.
+V
0110
1000
1010
"14" OR "15"
"14"
RUN
SEARCH
LOW COIL
SIGNAL CONDITIONER
TERMINAL COUNT
CLK
VOLTAGE DIVIDE AND SIG. CONDITIONER
INITIATE
ENGINE LOW COIL
ENGINE №1 CYL.

ENGINE CYLINDER IDENTIFICATION

BACKGROUND OF THE INVENTION

1. Field of Invention

This invention relates to electronic circuitry for generating a signal coincident with a selected cylinder ignition signal in an engine.

2. Description of the Prior Art

A number of diagnostic procedures relating to electric ignition internal combustion engines are dependent on identification of the timing of a selected cylinder, such as the ignition of the number one cylinder. It has been common simply to utilize the high voltage tapped off the number one cylinder ignition cable as a trigger or strobe pulse for operation of other apparatus, such as a timing light. However, in complex electronic engine analysis apparatus, the exact timing of the signal and the assurance that the detected signal is in fact the number one ignition signal, rather than a spurious noise signal of some sort, all become more important.

Although it is possible to use filtering techniques to filter out noise and to pass only signals at a given frequency whenever the signals are fixed in frequency, such techniques are not of any value at all where a signal, such as an ignition signal, although repetitive and cyclic in nature, has a randomly varying repetition rate or frequency.

SUMMARY OF THE INVENTION

The object of the present invention is to provide improvements in generation of a signal indicative of the timing of the ignition of a selected cylinder in an engine.

According to the present invention, coincidence of two sequential signals derived from the high voltage ignition cable of a selected cylinder in an engine with a conditioned signal derived from the low coil signal of the engine, is taken as an indication of the particular one of a given number of cyclic low coil signals (one per cylinder) which is coincident with the ignition of a selected cylinder, the repetition of said given number of low coil signals being utilized thereafter as the indication of timing of ignition of the selected cylinder. According further to the invention, apparatus is provided with two stable states, one state defining a search (or initialization) mode in which the coincidence of a pair of sequential ignition signals with every nth low coil signal (where n is the number of cylinders) without any signal in between is searched for, and when coincidence is achieved, the apparatus transfers into a second state defining a run mode in which every nth low coil signal is automatically taken to be coincident with the desired cylinder ignition signal, without even examining the desired cylinder ignition signal.

In still further accord with the invention, a counter is responsive to count engine low coil signals, repetitively for each electrical revolution of the engine, and each time the number of cylinders in the engine have been counted, it will either test for the number one condition when in the search mode or will issue a valid output signal when in the run mode. In accordance still further with the invention, the search mode can be initiated by external means (such as a hand switch or a command from a diagnostic apparatus) or in response to the counter reaching a terminal count (which indicates it has counted low coil signals in excess of the number of cylinders in the car without being reset or without sensing a coincident cylinder ignition signal).

The present invention avoids the necessity of complex apparatus for testing every ignition signal against low coil signals, with a commensurate delay in time required for a number of tests before issuing valid ignition timing signals representing a selected cylinder.

The foregoing and other objects, features and advantages of the present invention will become more apparent in the light of the following detailed description of a preferred embodiment thereof, as illustrated in the accompanying drawing.

BRIEF DESCRIPTION OF THE DRAWING

The sole FIGURE herein comprises a schematic block diagram of a preferred embodiment of the present invention.

BRIEF DESCRIPTION OF THE PREFERRED EMBODIMENT

Referring now to the drawing, a signal line 20 is connected to the high voltage ignition wire of a selected cylinder, such as the number one cylinder in an engine. The connection may be in any desired form, such as by an ordinary hard-wired tee of the type commonly used to trigger timing lights, or any other suitable connection. This signal is fed a voltage divider and signal conditioner circuit 22 which may be of any type known in the art, and may simply comprise some form of passive or active pulse shaping network with a suitable voltage reduction so as to prevent high voltage of the ignition coil from damaging the circuitry. The output of the voltage divider and signal conditioner circuit 22 is applied to an AND circuit 24 and to an OR circuit 26 on a line 28.

The low coil signal from the same engine is also applied on a line 30 to suitable signal conditioner circuitry 32, which may take the form of that disclosed and claimed in a commonly owned copending application of Albano et al, Ser. No. 554,805, filed on Mar. 3, 1975 and entitled DIGITAL NOISE DISCRIMINATOR. Alternatively, other signal conditioner circuitry may be utilized as desired. The output of the circuitry 32 on a line 34 is applied to the input of a counter 36 (which may be of a well known type, such as a TI-74163) so that the low coil signal from the conditioner 32 may be counted; and is also applied to an output AND circuit 38, which is described more fully hereinafter.

The basic apparatus is in either a run mode or a search mode in dependence upon the set or reset condition (respectively) of a D-type flip flop 40. The D-type flip flop 40 is clocked on a cyclic basis by timing signals on a line 41 from a suitable source such as an oscillator or a clock circuit 42. The clock circuit 42 may operate at a frequency wholly unrelated to the frequency of the engine being analyzed, and may operate, for instance, at 600 KHz. The flip flop 40 will be set into a set state, in which it provides, at its Q output, a run signal on a line 44 whenever the clock signal appears on the line 41 concurrently with the presence of a signal on a line 46 at the D input to the flip flop 40; on the other hand, whenever the clock signal on the line 41 appears at a point in time when there is no signal present on the line 46 at the D input to the flip flop, the flip flop 40 will be set into a reset state at which it provides a search signal on a line 48 from the not Q output thereof. Thus when the flip flop 40 is set, the run signal on the line 44 indicates that synchronized operation has been achieved; but when the flip flop 40 is reset, the search signal on the line 48 indicates that the initialization procedure is still under way, and valid recognition of the one of the many low coil signals concurrent with the selected cylinder ignition signal has not yet occurred.

The flip flop 40 will be reset with the absence of a signal on the line 46 whenever there is no output from a bistable control such as an AND circuit 50. This will be true whenever an inverter 52 provides no signal input to the AND circuit 50 due to the fact that there is one or the other signal provided on lines 54, 56 at the input to an OR circuit 58. In other words, if either signal is present at the input to the OR circuit 58, then the inverter 52 will block the AND circuit 50 so the flip flop 40 will automatically be put into the reset state upon the occurrence of the very next clock signal on the line 41. The AND circuit 50, however, must also receive an input from an OR circuit 60 which can either be on a line 62 from the AND circuit 38 (as described hereinafter) or on the line 44 indicating that the flip flop 40 is already in the set state and therefore can be continuously maintained in the set state with each clock signal. The signal on the line 62 from the AND circuit 38 will occur only when valid one signals have been detected as is described more fully hereinafter.

The OR circuit 58 may receive a signal on a line 56 from an initiate means 64 which may, for instance, comprise a switch 66 driven by a source of logically positive voltage 68. The switch 66, when depressed manually, transfers the line 56 from ground to the positive source 68, thereby to provide a signal to the OR circuit 58 so the inverter 52 will block the AND circuit 50, and the flip flop 40 will be conditioned to be reset as a result thereof. On the other hand, the initiate means 64 could be part of other diagnostic equipment, such as an electronic computer, which generates a signal whenever initialization of synchronization between a selected cylinder and a low coil signal is desired.

The OR circuit 58 may also respond in a fashion to cause resetting of the flip flop 40 as a result of a terminal count (that is a count of fifteen) being achieved in the four bit binary counter 36, an event which normally should not occur, indicating that too many low coil signals have been counted without other events occurring, and therefore the whole process should be started all over again. This is, in a sense, a redundant or fail safe condition-sensing feature which does not normally get called into play if everything is operating properly, either during the search mode or the run mode of the apparatus.

The counter 36 is preset to a certain count, such that by the addition of the number of low coil signals corresponding with the number of cylinders in the engine, a count of fourteen will be reached. This is achieved by a plurality of signal lines 70 driven by a binary encoder circuit 72 in response to a switch 74 connected to a suitable source of logically positive voltage 76. The switch 74 is set to a selected position in dependence upon the number of cylinders in the engine under diagnosis. For instance, when set to represent an eight cylinder engine, the signal input of binary encoder 72 will cause the signal lines 70 to present a binary number 0110 to the preset inputs of the counter 36. This is the equivalent of a preset count of six so that following the counting of eight cylinders, the counter will achieve a count of fourteen which is utilized for testing of coincidence and/or generation of a valid one in the AND circuit 38, as described hereinafter. On the other hand, if the switch 74 is set to indicate six cylinders, then the binary encoder 72 will cause the line 70 to present binary number 1000 to the preset input of the counter 36. This is equivalent to a count of eight, so that following the counting of six low coils (one for each of the six cylinders) the counter will achieve a count of fourteen for testing and/or generating a valid one signal. If the switch 74 is set to indicate four cylinders, then the binary encoder 72 will provide a count of 1010 (equivalent to ten) through the signal lines 70 so that the counter 36 will reach a count of fourteen after counting only four low coil signals. The preset inputs to the counter 36 are responsive to the signal lines 70, whenever a load signal is present on a line 80, so as to be preset to the count determined by the selective energization of the lines 70 at the preset input. On the other hand, when the load signal is not present on the line 80, then the counter will be responsive at its input so as to count the low coil signals on the line 34. Thus each time a load signal appears on the line 80, the counter is first preset, and when the load signal disappears, it is again responsive to the low coil signals on the line 34, so that counting of the number of low coil signals will be resumed.

This is, in a sense, the way that the circuitry is reinitiated and cylically restored so as to stay in synchronism with the counts of the low coil signals from the engine.

The signal on the line 80 is generated by an OR circuit 82 in response to either of two AND circuits 24, 84. The AND circuit 24 will operate the OR circuit 82, when in the search mode, in response to receipt of a number one cylinder signal on the line 28. The AND circuit 84 is responsive to a count of 14 or 15 as indicated by a signal on a line 86 from an AND circuit 88 whenever the circuitry is in the run mode, as indicated by the signal on the line 44. Thus the counter is loaded (or preset) when searching and a number one signal is received from the engine, or after synchronization is achieved and in the run mode, whenever the fourteen count is reached (the fifteen count being redundant since it is only reached after the fourteen count).

In operation, consider that the engine is running and the apparatus is connected thereto as is known. The selected cylinder ignition signals (high voltage spark) coincide with the related ones of the low coil signals, so that signals on the lines 30 are concurrent with each signal on the line 20. Without regard to the initial condition of the system, operation is commenced by depressing of the switch 66 in the initiate means 64, thereby providing a signal on the line 56 so that the OR circuit 58 will operate the inverter 52 which in turn will provide no signal to the AND circuit 50, such that the AND circuit 50 becomes blocked and no signal is provided on the line 46 to the D input of the flip flop 40. The very next clock signal on the line 41 will cause the flip flop 40 to assume the reset condition, so that its not Q output will provide the search signal on the line 48. The timing of this is relatively immaterial; sometime after the search signal appears on the line 48, the voltage divide and signal conditioner circuitry 22 will recognize a signal on the line 20 and cause a signal on the line 28 which will operate the AND circuit 24, and in turn the OR circuit 82 to generate the load signal on the line 80. This will cause the counter to be preset by the desired amount in dependence upon setting of the switch 74, as described hereinbefore.

At the end of the number one cylinder signal on the line 28, the AND circuit 24 again becomes blocked so that the OR circuit 82 no longer presents the load signal on the line 80. Thus the counter can once again respond to input signals on the line 34 from the signal conditioner 32, which are commensurate with the engine low coil signals on the line 30. Thus, the counter is not responsive to the low coil signal which coincides with the number one cylinder signal that causes it to be loaded, since the presence of the load signal makes the counter nonresponsive at its input. However all subsequent low coil signals will be applied on the line 34 to the input of the counter, and it will count them until it reaches a count of 14 (if another signal does not occur on the line 28 in the meantime) at which time its output signals for the high order three bits on lines 90–92 will operate the AND circuit 88 to generate a signal on the line 86; but since the flip flop 40 is in the reset state, there is no run signal on the line 44 so the AND circuit 84 will do nothing at this time. On the other hand, however, the same high order signals on the lines 90–92 together with the lowest ordered bit on the line 94 being absent, as applied to an inverter 96, will tend to activiate the AND circuit 38 upon a count of exactly 14 in the counter 36. The AND circuit 38 will operate if there is a low coil signal on the line 34 and a signal on the line 98 from the OR circuit 26, which will be true if a count of 14 is achieved with the low coil signal and a number one signal present on the line 28. The AND circuit 38 generates a valid one signal on a line 62, which is taken as the output of the system, and which is also applied to the OR circuit 60 to operate the AND circuit 50 (provided there is no input to the OR circuit 58, so that the inverter 52 does provide an input to the AND circuit 50), causing the signal on the line 46 to enable the D input of the flip flop 40. The very next clock signal therefore will cause the flip flop 40 to switch into the set state, no longer presenting the search signal on the line 48 but presenting the run signal on the line 44. Since this happens at electronic speeds, in fact the signal on the line 86 will enable the AND circuit 84 so that the OR circuit 82 will generate the load signal on the line 80, causing the counter to again become preset to a desired count (14 less the number of cylinders), after which counting of low coil signals on the line 34 can resume.

At this point, apparatus is in the run mode and is no longer interested in whether or not number one cylinder signals are provided on the line 20 from the engine. Instead, the circuit assumes that every nth low coil signal will be coincident with the desired cylinder firing, which will be true provided no low coil signals are missing. After again counting a number of low coil signals equal to the number of cylinders in the engine, the signal lines 90–94 will again present a count of 14 to the AND circuit 38, commensurately with the nth low coil signal on the line 34, and the OR circuit 26 will present a signal on the line 98 since it is responsive to the run signal on the line 44; so that, once again, a valid one signal will issue on the line 62. It is to be noted that once the flip flop 40 is set into the run condition, the signal on the line 44 is continuously presented through the OR circuit 60 so as to maintain the AND circuit 50 active, thereby causing the D input of the flip flop 40 to continuously be conditioned so the flip flop will remain in a set state until one of the other inputs is again presented to the OR circuit 58. This could happen if, for some reason or other, the counter was allowed to reach a terminal count of 15, or if reinitialization were established by the initiate means 64 providing the signal on the line 56. Otherwise, the circuit will continue to generate a valid one signal on the line 62 for every nth low coil signal on the line 34 counted by the counter 36, where $n$ is the number of cylinders as determined by cylinder selection switch 74.

If, on the other hand, a second signal were provided on the line 28 (such as may be due to noise) before the nth low coil signal on the line 34 has been sensed, if the apparatus is still in the search mode (as indicated by the signal on the line 48), then the AND circuit 24, through the OR circuit 82, will cause the load signal on the line 80 to again preset the counter and render it temporarily unresponsive to input signals, thereby starting off a new cycle. This in turn would most likely be followed within less than n low coil signals by a true number one cylinder signal on the line 28 so that it would again be reset. Thus the counter could be reset over and over in time frames of less than one electrical revolution of the engine, if there were too much noise on the line.

One other condition that may occur is that a second number one cylinder signal on the line 20 is not passed through the signal conditioner 22 to the line 28, so that when a count of fourteen is reached in the counter, indicating that the requisite number of low coil signals have been counted commensurate with the number of cylinders in the engine, then the counter would count to 15 causing a terminal count signal on the line 54 which would put the counter into the hold condition (due to its own internal connections) and which would operate the OR circuit 58 thus insuring that the flip flop 40 would be put into the reset state; then the next number one would start it off again.

However, once the system is in the run mode, the presence or absence of number one cylinder signals on the line 20 is no longer relevant, and this is the important aspect of the present invention that renders it far more valuable than the circuits of a similar type known to the prior art. In other words, once the low coil signal which is coincident with the number one cylinder is sensed, no more attention is paid to the high voltage ignition signal being provided to the number one cylinder, but simply cyclic, repetitive keeping-track of the low coil signals is all that is utilized to generate the valid one signal on the line 62.

Although the invention has been shown and described with respect to a preferred embodiment therefore, it should be understood by those skilled in the art that various changes, omissions and additions may be made therein and thereto without departing from the spirit and the scope of the invention.

Having thus described a typical embodiment of our invention, that which we claim as new and desire to secure by Letters Patent is:

1. Apparatus for generating a signal coincident with the firing of a selected cylinder in an electric ignition internal combustion engine having $n$ cylinders, comprising:

bistable means settable into either one of two stable states and generating a run signal when in one stable state and generating a search signal when in the other stable state;

counter means adapted for connection to the low side of the coil of the engine for counting engine low coil signals and for providing count signals indicating said counter has counted n low coil signals;

means adapted for connection to the high voltage ignition wire of a selected cylinder of the engine for generating a selected cylinder signal;

means responsive to said search signal and to said selected cylinder signal for causing said counter to initiate a count of said low coil signals;

output means connected for response to the output of said counter means, said low coil signals, and said ignition signal and operative in response to concurrence of said count signals, a low coil signal and said selected cylinder signal or said run signal for generating a valid one signal; and load means connected for response to said counter means and to said bistable means and operative in response to either concurrence of said run signal and said count signals or concurrence of said search signal and said selected cylinder signal to reinitiate counting of said low coil signals.

2. Apparatus according to claim 1 including bistable control means connected to said output means and operative in response to said valid one signal to cause said bistable means to be set into its first state so as to generate said run signal.

3. Apparatus accoring to claim 2 wherein said bistable control means is also responsive to said run signal to continuously enable said flip flop to be set into said first state.

4. Apparatus according to claim 2 further comprising:

selectively operable initiation means for generating and initiating signal; and wherein said bistable control means is responsive to said initiating signal to cause said bistable means to be set into the second one of said states.

5. Apparatus according to claim 2 wherein said bistable control means is connected for a response to said counter means and is responsive to signals indicating said counter has counted more than n low coil signals to cause said bistable means to be set into the second one of said states.

6. Apparatus according to claim 3 further comprising:

selectively operable initiation means for generating and initiating signal; and wherein said bistable control means is responsive to said initiating signal to cause said bistable means to be set into the second one of said states.

7. Apparatus according to claim 3 wherein said bistable control means is connected for a response to said counter means and is responsive to signals indicating said counter has counted more than n low coil signals to cause said bistable means to be set into the second one of said states.

8. Apparatus according to claim 1 wherein said counter means comprises a presetable counter having a load control input said load means provides a load signal to said load control input to reinitiate counting of said low coil signals, and further comprising:

means settable in dependence upon the number of cylinders in the engine to preset said counter to a number which is n plus one less than the terminal count of said counter.

9. Apparatus according to claim 8 wherein said counter has a terminal count output and a count hold input, said terminal count output being applied to said count hold input, whereby once reaching its terminal count said counter will hold said terminal count until said load means causes reinitiation of counting of said low coil signals, and wherein said bistable control means is connected to said terminal count output and is responsive thereto to cause said bistable means to be set into the second one of said states.

* * * * *